US006920996B1

(12) United States Patent
Brassington

(10) Patent No.: US 6,920,996 B1
(45) Date of Patent: Jul. 26, 2005

(54) INSULATED FREIGHT CONTAINER AND A TOP RAIL THEREFOR

(75) Inventor: Anthony William Brassington, London (GB)

(73) Assignee: Sea Containers Services Ltd., London (GB)

( * ) Notice: Subject to any disclaimer, the term of this patent is extended or adjusted under 35 U.S.C. 154(b) by 0 days.

(21) Appl. No.: 09/889,207

(22) PCT Filed: Jan. 12, 2000

(86) PCT No.: PCT/GB00/00059

§ 371 (c)(1),
(2), (4) Date: Sep. 28, 2001

(87) PCT Pub. No.: WO00/41952

PCT Pub. Date: Jul. 20, 2000

(30) Foreign Application Priority Data

Jan. 13, 1999 (GB) ..... 9900701

(51) Int. Cl.[7] ..... B65D 90/02

(52) U.S. Cl. ..... 220/592.25; 220/592.2; 220/1.5

(58) Field of Search ..... 220/1.5, 592.2, 220/592.25, 592.01, 592.02, 592.09, 592.1; 105/404, 409

(56) References Cited

U.S. PATENT DOCUMENTS

| | | | | |
|---|---|---|---|---|
| 2,585,976 A | * | 2/1952 | Teeter | 52/266 |
| 3,481,642 A | * | 12/1969 | Bonallack et al. | 296/181 |
| 4,271,975 A | | 6/1981 | Ketner et al. | 220/80 |

FOREIGN PATENT DOCUMENTS

| | | |
|---|---|---|
| EP | 0321009 | 6/1989 |
| EP | 0367275 | 5/1990 |
| GB | 1553447 | 9/1979 |
| GB | 2019363 | 10/1979 |
| GB | 2180802 | 4/1987 |
| WO | 8101401 | 5/1981 |

* cited by examiner

*Primary Examiner*—Stephen Castellano
(74) *Attorney, Agent, or Firm*—Ladas & Parry LLP

(57) ABSTRACT

An insulated double-skinned freight container having foam insulation (15) between the skins (11, 16, 17, 18) and a top rail forming a junction between an outer skin (11) of a side wall of the container and an outer skin (18) of a roof panel of the container. The rail includes a first web portion attached to the outer skin of the side wall, an inwardly inclined second web portion at a first obtuse angle to the first portion and a third web portion substantially perpendicular to the first web portion for attachment to the outer skin of the roof panel. The third web portion is provided with an inwardly extending return portion at an edge of the third web portion embedded in the foam insulation between the inner and outer skins.

13 Claims, 4 Drawing Sheets

INSULATED FREIGHT CONTAINER AND A TOP RAIL THEREFOR

This invention relates to an insulated freight container and to a top rail therefor.

Figure 1:
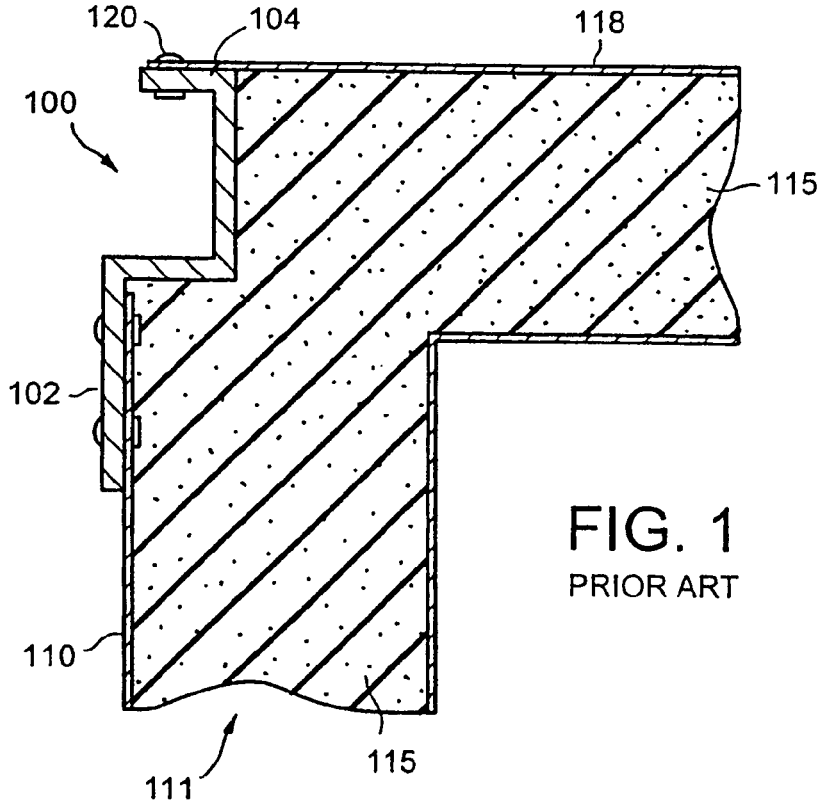
FIG. 1 PRIOR ART

A known insulated freight container has an inner and outer skin with an interstitial space between the skins filled with an insulating solidified foam. The outer skin is typically of aluminium and the inner skin of stainless steel. The outer roof skin and outer side skin are connected together by an extruded top rail. As shown in FIG. 1, the top rail 100 has a transverse cross-sectional shape similar to a query mark. A vertical portion 102 of the rail 100 is riveted to the outer side skin 110 before the container is fully assembled and before the interstitial spaces 111 are completely filled with foam 115. As is evident from FIG. 1, an upper portion 104 of the rail 100 is oriented outwards of the container in order that both sides of this portion 104 are accessible for riveting the outer skin of a roof panel 118 to the rail 100 after the rail is riveted to the outer side skin 110.

However, the above container has a number of disadvantages. The fixing of rivets 120 is labour intensive and time consuming and apertures necessary for the rivets 120 tend to weaken the roof panel 118. As a result, the roof panel 118 may tear or buckle allowing the ingress of water into the interstitial space 111 and thereby destroy the insulating property of the foam 115. Moreover, the rivet holes tend to elongate as the container flexes, again allowing the ingress of water. In addition, the protruding upper portion 104 of the rail 100 is liable to damage in collision with other containers during the stacking of containers. Despite these difficulties, there is a strong prejudice in the art towards the riveting of panels to rails, in particular, in the case of aluminum rails and panels.

It is an object of this invention to provide an improved top rail for an insulated freight container and an improved method of manufacturing such a freight container.

According to one aspect of this invention there is provided a top rail for an insulated double-skinned freight container, the rail being for forming a junction between an outer skin of a side wall and an outer skin of a roof panel of the container, wherein the rail comprises a first portion for attachment to the outer skin of the side wall, an angled second portion at a first obtuse angle to the first portion and adapted to be angled inwardly of the container in use and a third portion for attachment to the outer skin of the roof panel angled at a second obtuse angle to the angled second portion so that the third portion is substantially perpendicular to the first portion, the rail being adapted to be welded to at least one of the outer skin of the side panel and the outer skin of the roof panel, characterised by a first return member arranged to be substantially perpendicular to the third portion at a location of the third portion remote from the angled second portion and a second return member arranged substantially perpendicular to the first portion at a location remote from the angled second portion, said first and second return members being disposed inwardly of the container in use to reduce flexing in a vertical direction and axial twisting of said rail and wherein the rail is formed of aluminium.

Conveniently the first obtuse angle is between 140 degrees and 160 degrees.

According to a second aspect of this invention, there is provided an insulated freight container having a top rail, the top rail forming a junction between an outer skin of a side wall and an outer skin of a roof panel of the container, wherein the rail comprises a first portion for attachment to the outer skin of the side wall, an angled second portion which is angled at a first obtuse angle to the first portion and angled inwardly of the container and a third portion attached to the outer skin of the roof and angled at a second obtuse angle to the angled second portion so that the third portion is substantially perpendicular to the first portion and the rail is welded to at least one of the outer skin of the side wall and the outer skin of the roof panel, characterised by a first return member arranged to be substantially perpendicular to the third portion at a location of the third portion remote from the angled second portion and a second return member arranged substantially perpendicular to the first portion at a location remote from the angled second portion, said first and second return members being disposed inwardly of the container in use to reduce flexing in a vertical direction and axial twisting of said rail and wherein the rail and the outer skin of the roof panel and/or the outer skin of the side panel are of aluminium.

Conveniently, the first obtuse angle is between 140 degrees and 160 degrees.

According to a third aspect of this invention there is provided a method of manufacturing an insulated double-skinned freight container comprising the steps of:

a) providing an outer and inner skin of a floor panel, b) locating the inner skin of the floor panel parallel to and spaced from the outer skin by foam spacing stanchions, c) injecting foam between the inner and outer skins, d) providing outer skins and inner skins of side panels, locating the inner skins parallel to the respective outer skins and spaced from them by foam spacing stanchions, inserting foam between the inner and outer skins, e) fixing an edge of the side panels to the floor panel by a known method to form side walls of the container and filling joints between the floor panel and side panels with foam, f) providing aluminium top rails having a first portion for attachment to each outer skin of each side wall respectively, an angled second portion at a first obtuse angle to the first portion and adapted to be angled inwardly of the container in use and a third portion for attachment to an outer skin of a roof panel, angled at a second obtuse angle to the angled portion so that the third portion is substantially perpendicular to the first portion, and having a first return member arranged substantially perpendicular to the third portion at a location of the third portion remote from the angled second portion and a second return member arranged substantially perpendicular to the first portion at a location remote from the angled second portion, said first and second return members being disposed inwardly of the container in use to reduce flexing in a vertical direction and axial twisting of said rail.

g) riveting said top rails to the outer skins of the side walls respectively, fixing with a known method an inner skin of the roof panel to the inner skins of the side walls respectively, h) welding an outer skin of the roof panel to the third portion of the top rail and filling the space between the inner and outer skins of the roof panel with foam, wherein said return members are located in said foam and substantially prevent flexing of the rail in a vertical direction and axial twisting of said rail.

The rail of the present invention has the advantage of providing added strength and providing greater protection to the top rail from impact damage than rails of the prior art since the rail has no protruding portion. The top rail of the invention also has a smaller total cross section area than the rails of the prior art, but with the material concentrated where the greatest strength is required, i.e. on the angled section. The use of a welded joint also avoids weakening the outer skin by riveting, and reduces the likelihood of the ingress of water into the insulation foam.

Figure 2:
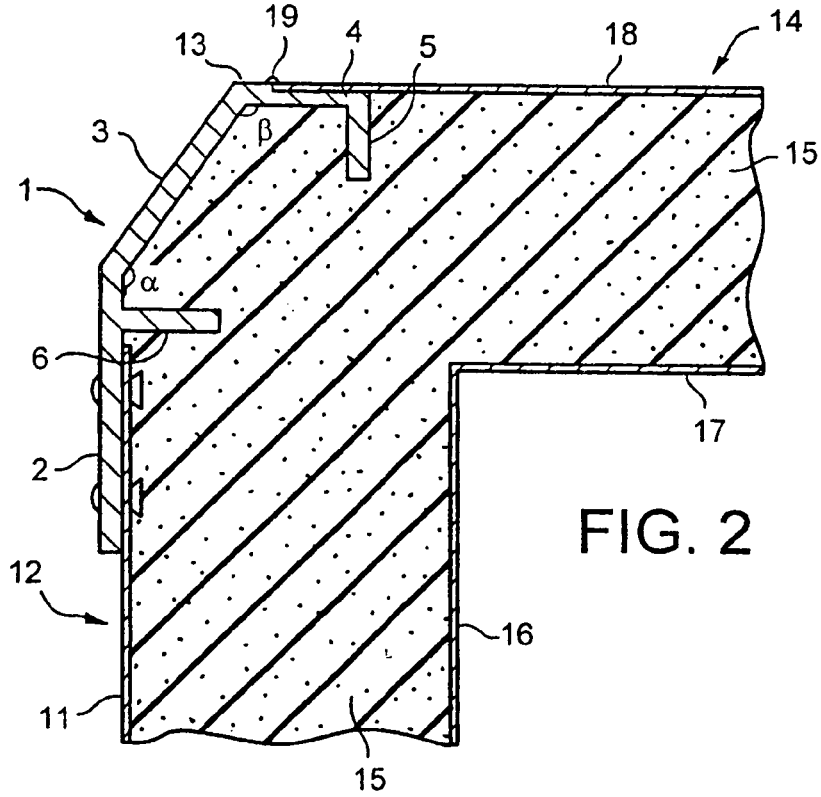
Figure 3:
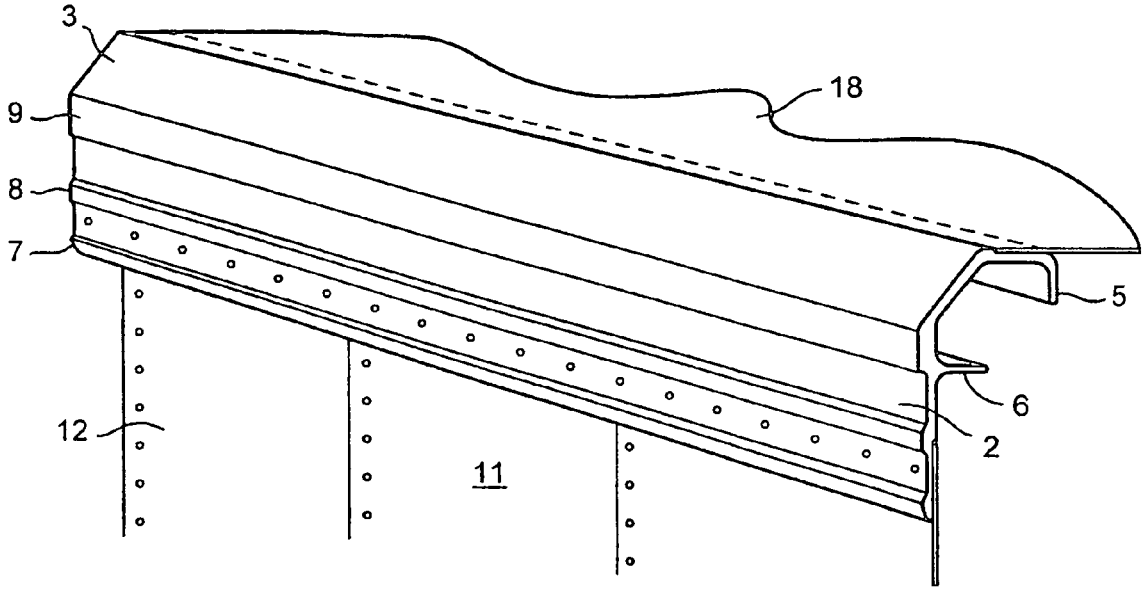
Figure 4:
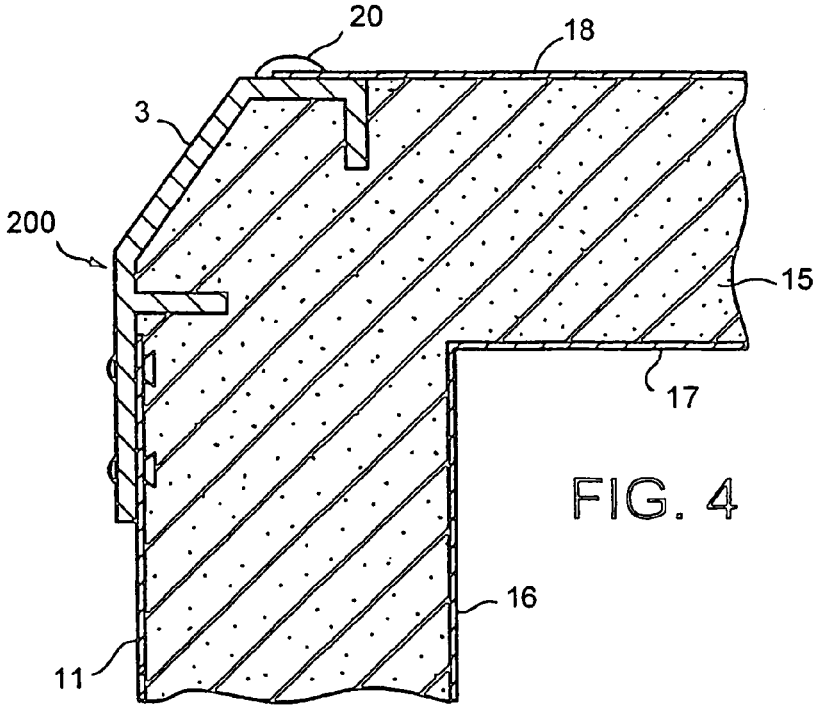
Figure 5:
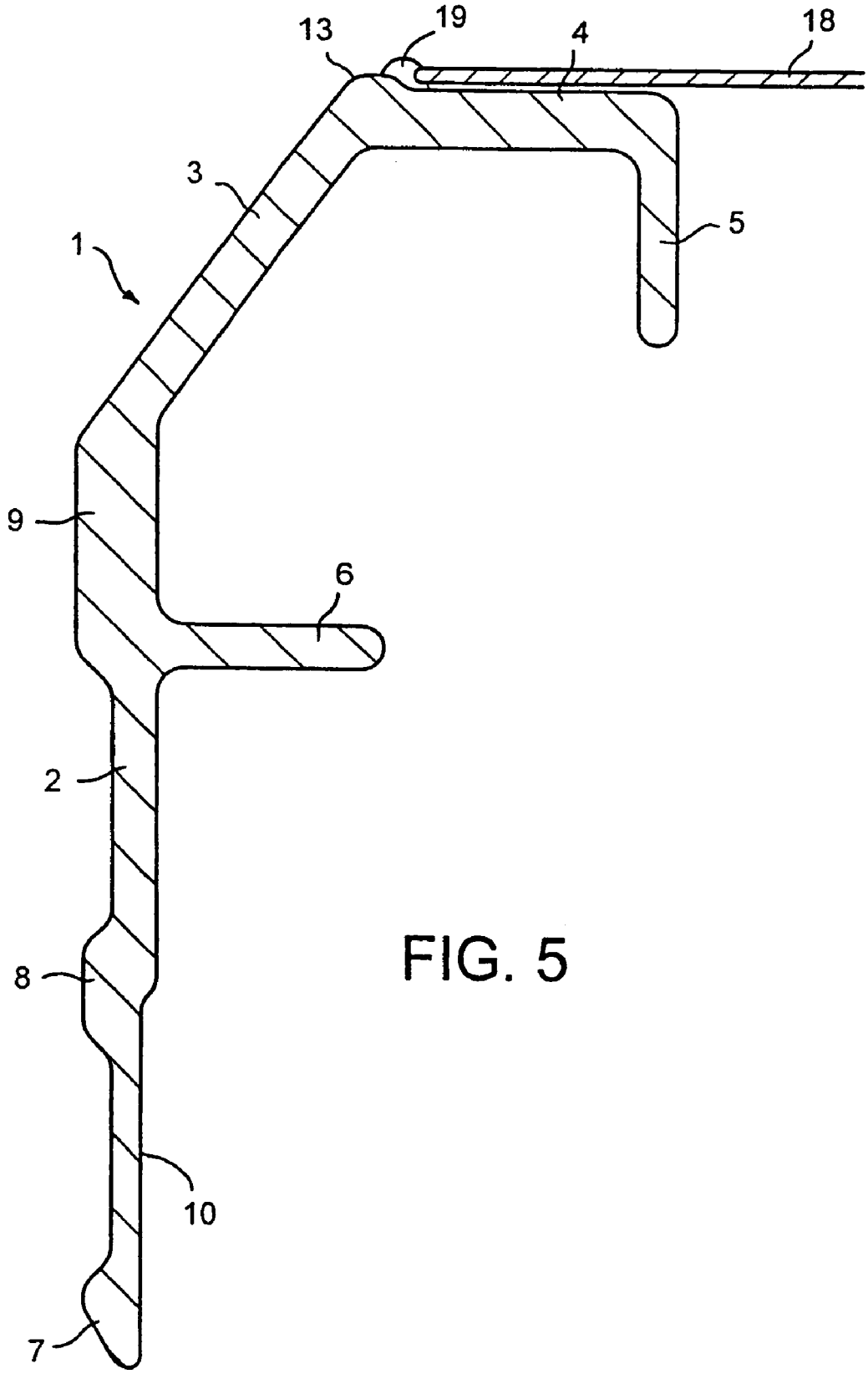
Figure 6:
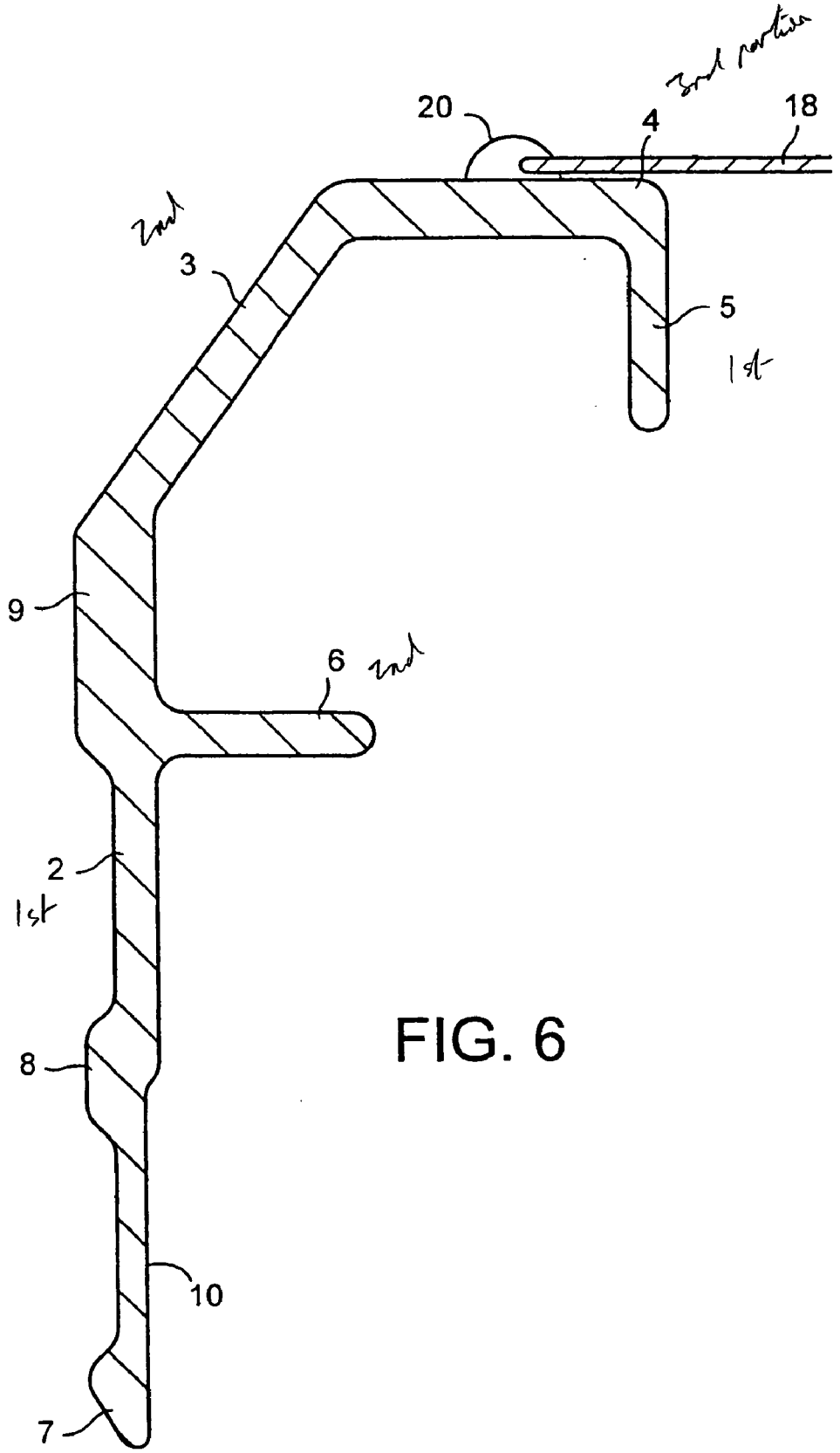

The invention will now be described by way of example with reference to the accompanying drawing in which;

FIG. 1 shows a prior art transverse cross-section of a top rail installed in a container, FIG. 2 shows a transverse cross-section of a top rail according to the invention, installed in a container, FIG. 3 shows a perspective view of the top rail of FIG. 2 installed in a container, FIG. 4 shows a transverse cross-section of an alternative embodiment of the top rail according to the invention installed in a container, FIG. 5 shows an enlarged view of a transverse cross-section of the top rail of FIGS. 2 & 3, and FIG. 6 shows an enlarged view of a transverse cross-section of the top rail of FIG. 4.

In the figures like reference numerals denote like parts.

An aluminium top rail 1 shown in transverse cross-section in FIG. 2 has a first vertical portion 2, a second angled portion 3 angled inwards of the container in use at an angle $\alpha$ of 150 degrees to the first portion and third horizontal portion 4 connected at an angle $\beta$ of 120 degrees of the angled portion 3 and oriented at right angles to the vertical portion 2. The first, second and third portions 2, 3, 4 of the rail 1 thereby form a chamfered right angle. The third portion 4 is provided with a return portion 5 connected by an edge of the return portion 5 to an edge of the third portion 4 remote from the second angled portion 3, the return portion 5 being at right angles to the third portion 4 and inward of the container in use.

The vertical portion 2 is provided with a web 6 perpendicular to the vertical portion 2 and located on the vertical portion 2 proximate a junction between the vertical portion 2 and the angled portion 3 and inward of the container in use.

As can be seen in the enlarged drawings of FIG. 5 or 6, the vertical portion 2 is further provided with lower, median and upper horizontal ribs 7, 8, 9, at upper and lower edges of the portion 2 and substantially along a median line of the portion 2 on an outer surface of the rail 1. The inner surface of the vertical section 2 is provided with a cut-away portion 10 extending substantially from a position opposite the lower rib 7 to a position opposite the median rib 8, for receiving an outer skin 11 of a side panel 12.

The third portion 4 may also be provided with a longitudinal bead 13, raised above an outer surface of the portion 4 at a junction between the portion 4 and the angled portion 3.

In the manufacture of a freight container using the top rail 1 of the invention, the floor and side panels are constructed from inner and outer skins 16, 11 with foam 15 in the interstitial space between the skins in a manner known per se, the inner and outer skins being placed parallel with each other, separated by foam stanchions and the interstitial space being injected with foam 15 so that the inner and outer skins 16, 11 are held together by the foam 15 when the foam sets. The top rail 1 is riveted to the outer skin 11 of the side panel 12, the outer skin 11 of the side panel 12 being accommodated in the cut-away 10 in the inner surface of the vertical section 2. An inner skin 17 of the top panel 14 is attached to the inner skin 16 of the side panels in a known manner and the outer skin 18 is welded to the top rail 1 by a weld bead 20 or with an edge of the outer skin 18 abutting the longitudinal bead 13 where present, secured by a weld bead 19, with the outer skin 18 partially overlapping the horizontal section 4. The interstitial space between the outer and inner skins 18, 17 of the top panel 14 is injected with foam 15 so that the return portion 5 of the top rail 1 and the web 6 are embedded in the set foam 15.

Although it is normally more efficient to weld the top panel 14 to the rail 1, it will be understood that the outer skin of the top panel 14 could be riveted to the rail 1 and the outer skin 11 of the side panel 12 welded to the rail 1, or both panels 12 and 14 could be welded to the rail 1. Instead of welding, a suitable adhesive may be used.

The return section 5 and the web 6 impart strength to the rail 1 in axial twisting so that the rail 1 according to the invention is stronger than the rails of the prior art in relation to flexing in a vertical direction and equally strong in respect of axial twisting. The web 6 also forms a convenient boundary for an initial insertion of foam within the side wall before the top panel is assembled to the rail, and a final foaming of the corner between the side wall and the top panel. In addition, the web 6 facilitates molding in the manufacture of the rail 1.

A second embodiment of the invention is shown in the transverse cross-section in FIG. 4, in this embodiment the portion 4 is not provided with a bead and the weld bead 20 overlaps the edge of the outer skin of the top panel, the top panel partially overlapping the portion 4 of the rail 1.

The strengthening ribs 7,8,9 of the vertical portion 2 provide strength against side impacts and the angled portion 3 of the rail assists in glancing off impacting containers in collisions during stacking.

The total cross-sectional area of the rail of the invention is less than the total cross-section area of rails of the prior art and therefore less material is used in the construction of the rail and yet the strength is concentrated in the angled section where damage is mostly likely to occur. Additional strength is provided by the strengthening ribs 7,8,9 on the vertical section 2 and by the web 6 and the return portion 5.

What is claimed is:

1. A top rail (1) for an insulated double-skinned freight container having foam insulation (15) between the skins (11, 16, 17, 18), the rail forming a junction between an outer skin (11) of a side wall and an outer skin (18) of a roof panel of the container, the rail comprising a first web portion (2) for attachment to the outer skin of the side wall, an inwardly inclined second web portion (3) at a first obtuse angle (2) to the first portion and a third web portion (4) extending substantially perpendicular to the first web portion (2) for attachment to the outer skin (18) of the roof panel, the rail being adapted to be welded to at least one of the outer skin of the side panel and the outer skin of the roof panel, said third web portion (4) being inwardly inclined at a second obtuse angle ($\beta$) to the second web portion (3) and being provided with an inwardly extending return portion (5) at an edge of the third web portion (4) remote from the second web portion (3) for strengthening the top rail and embedded in and surrounded by the foam insulation between the inner and outer skins, wherein said outer skin of the roof panel (18) extends on and over said third web portion (4) said third web portion having a notch with a step against which said outer skin of said roof portion faces when placed in said notch on said third web portion.

2. A top rail (1) as claimed in claim 1, wherein said first web portion (2) has an inwardly extending further web portion (6) perpendicular to said first web portion, said further web portion being embedded in and surrounded by the foam insulation between the inner and outer skins.

3. A top rail (1) as claimed in claim 1, wherein the first obtuse angle is between 140 degrees and 160 degrees.

4. A top rail (1) according to claim 1, wherein an outer surface of said third web portion (4) is provided with a longitudinal bead (19) against which the outer skin (18) of said roof panel is arranged to abut to provide a welding edge.

5. The top rail as claimed in claim 4, wherein the rail (1) or the outer skin (11) of the side wall or the outer skin (18) of the roof or combinations thereof are made of aluminum.

6. The top rail as claimed in claim 4, wherein said outer skin of the roof panel extends on said third web portion.

7. The top rail as claimed in claim 6, wherein said outer skin extends in a notch on an upper surface of said third web portion.

8. The top rail as claimed in claim 4, wherein said third web portion extends in said foam insulation (15).

9. A top rail (1) according to claim 2, wherein said further web portion (6) is located on said first web portion (2) in proximity to said second web portion (3).

10. A top rail (1) according to claim 9, wherein said second web portion (3) is in contact with said foam insulation.

11. A top rail (1) according to claim 2, wherein said return portion (5) and said further web portion (6) extend perpendicular to one another.

12. A top rail (1) according to claim 1, wherein said inwardly extending return portion is bent substantially at right angles at the end of the third web portion.

13. A top rail (1) according to claim 2, wherein said further web portion projects integrally from said first web portion.

* * * * *